US011053781B2

(12) United States Patent
Batarseh

(10) Patent No.: US 11,053,781 B2
(45) Date of Patent: Jul. 6, 2021

(54) LASER ARRAY DRILLING TOOL AND RELATED METHODS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 134 days.

(21) Appl. No.: 16/439,400

(22) Filed: Jun. 12, 2019

(65) Prior Publication Data

US 2020/0392818 A1 Dec. 17, 2020

(51) Int. Cl.

| | |
|---|---|
| ***E21B 43/11*** | (2006.01) |
| ***E21B 7/15*** | (2006.01) |
| *E21B 17/10* | (2006.01) |

(52) U.S. Cl.

CPC ..... *E21B 43/11* (2013.01); *E21B 7/15* (2013.01); *E21B 17/1078* (2013.01)

(58) Field of Classification Search

CPC ... E21B 43/11; E21B 7/14; E21B 7/15; E21B 29/02

See application file for complete search history.

(56) References Cited

U.S. PATENT DOCUMENTS

| | | | | |
|---|---|---|---|---|
| 4,282,940 | A * | 8/1981 | Salisbury | B26F 1/31 175/11 |
| 5,458,199 | A | 10/1995 | Collins et al. | |
| 5,564,503 | A | 10/1996 | Longbottom et al. | |
| 5,944,108 | A | 8/1999 | Baugh et al. | |
| 5,996,711 | A | 12/1999 | Ohmer | |
| 6,283,216 | B1 | 9/2001 | Ohmer | |
| 6,531,694 | B2 | 3/2003 | Tubel et al. | |
| 6,755,262 | B2 | 6/2004 | Parker | |
| 6,880,646 | B2 | 4/2005 | Batarseh | |
| 6,888,097 | B2 | 5/2005 | Batarseh | |
| 7,185,718 | B2 | 3/2007 | Gardes | |
| 7,370,701 | B2 | 5/2008 | Surjaatmadja et al. | |
| 7,416,258 | B2 | 8/2008 | Reed et al. | |
| 7,617,873 | B2 | 11/2009 | Lovell et al. | |
| 7,929,812 | B2 | 4/2011 | Vannuffelen et al. | |
| 8,528,643 | B2 | 9/2013 | Schultz et al. | |
| 8,813,844 | B2 | 8/2014 | Hopkins et al. | |
| 8,967,297 | B2 | 3/2015 | Orban et al. | |
| 9,217,291 | B2 | 12/2015 | Batarseh | |
| 9,567,842 | B2 | 2/2017 | Wilfing et al. | |
| 9,677,339 | B2 | 6/2017 | Linetskiy et al. | |

(Continued)

FOREIGN PATENT DOCUMENTS

| | | |
|---|---|---|
| CN | 102155196 A | 8/2011 |
| CN | 203081295 U | 7/2013 |

(Continued)

OTHER PUBLICATIONS

International Search Report for PCT/IB2019/056778, 4 pages (dated Mar. 9, 2020).

(Continued)

*Primary Examiner* — David Carroll

(74) *Attorney, Agent, or Firm* — Choate, Hall & Stewart LLP; Charles E. Lyon; Alexander D. Augst

(57) ABSTRACT

This application relates to systems and methods for stimulating hydrocarbon bearing formations using a downhole laser tool.

22 Claims, 11 Drawing Sheets

(56) References Cited

U.S. PATENT DOCUMENTS

| | | | | |
|---|---|---|---|---|
| 9,777,554 | B2 | 10/2017 | Tunget | |
| 2004/0206505 | A1* | 10/2004 | Batarseh | E21B 43/11 166/302 |
| 2004/0256103 | A1* | 12/2004 | Batarseh | B23K 26/382 166/297 |
| 2010/0326659 | A1 | 12/2010 | Schultz et al. | |
| 2014/0231147 | A1 | 8/2014 | Bozso et al. | |
| 2014/0345861 | A1 | 11/2014 | Stalder et al. | |
| 2014/0360778 | A1 | 12/2014 | Batarseh | |
| 2015/0129203 | A1 | 5/2015 | Deutch et al. | |
| 2015/0198022 | A1 | 7/2015 | Stanecki et al. | |
| 2016/0160618 | A1 | 6/2016 | Batarseh et al. | |
| 2016/0348439 | A1 | 12/2016 | Wang et al. | |

FOREIGN PATENT DOCUMENTS

| | | | |
|---|---|---|---|
| CN | 203334954 | U | 12/2013 |
| EP | 0013657 | A1 | 7/1980 |
| GB | 2 420 135 | A | 5/2006 |
| WO | WO-2020/250024 | A1 | 12/2020 |

OTHER PUBLICATIONS

Written Opinion for PCT/IB2019/056778, 8 pages (dated Mar. 9, 2020).

* cited by examiner

LASER ARRAY DRILLING TOOL AND RELATED METHODS

TECHNICAL FIELD

This application relates to laser tools and related systems and methods for stimulating hydrocarbon bearing formations using high power lasers.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and into the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits on the penetration depth and diameter of the tunnels. There is a risk in involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

High power laser systems can also be used in a downhole application for stimulating the formation via, for example, laser drilling a clean, controlled hole. Laser drilling typically saves time, because laser drilling does not require pipe connections like conventional drilling, and is a more environmentally friendly technology with far fewer emissions, as the laser is electrically powered. However, there are still limitations regarding the placement and maneuverability of a laser tool for effective downhole use.

SUMMARY

Conventional methods for drilling holes in a formation have been consistent in the use of mechanical force by rotating a bit. Problems with this method include damage to the formation, damage to the bit, and the difficulty to steer the drilling assembly with greater accuracy. Moreover, drilling through a hard formation has proven very difficult, slow, and expensive. However, the current state of the art in laser technology can be used to tackle these challenges. Generally, because a laser provides thermal input, it will break the bonds and cementation between particles and simply push them out of the way. Drilling through a hard formation will be easier and faster, in part, because the disclosed methods and systems will eliminate the need to pull out of the wellbore to replace the drill bit after wearing out and can go through any formation regardless of its compressive strength.

The present disclosure relates to new tools and methods for drilling a hole(s) in a subsurface formation utilizing high power laser energy. In particular, various embodiments of the disclosed tools and methods use a high power laser(s) with a laser source (generator) located on the surface, typically in the vicinity of a wellbore, with the power conveyed via optical transmission media, such as fiber optic cables, down the wellbore to a downhole target via a laser tool. Generally, the tool described in this application can drill, perforate, and orient itself in any direction.

Generally, the laser generating unit is configured to generate a high power laser beam. The laser generating unit is in electrical communication with the fiber optic cable. The fiber optic cable is configured to conduct the high power laser beam. The fiber optic cable includes an insulation cable configured to resist high temperature and high pressure, a protective laser fiber cable configured to conduct the high power laser beam, a laser surface end configured to receive the high power laser beam, a laser cable end configured to emit a raw laser beam from the fiber optic cable. In some embodiments, the system includes an optional outer casing or housing placed within an existing wellbore that extends within a hydrocarbon bearing formation to further protect the fiber optic cable(s), power lines, or fluid lines that make up the laser tool.

In various embodiments, the laser tool includes an optical assembly configured to shape a laser beam for output. The laser beam may have an optical power of at least one kilowatt (1 kW). In some embodiments, the laser beam has an optical power of up to 10 kW. The laser tool provides the means to drill, perforate and establish communication between the wellbore and formation for maximum production and characterization. It is an integrated tool that combines one or more arrays of high power lasers with low power laser (fiber optics sensing), orientation means, acoustic sensing, and an optical assembly. The tool is capable of drilling holes and characterizing the formation in any direction and at any length regardless of the rock strength, stress orientation or formation type.

The tool is configured to drill and produce from conventional and unconventional reservoirs using multiple high power laser arrays and associated methods for use. Generally, the tool utilizes the power of photonics delivered by multiple fibers optic assemblies that are bundled in a tool motherboard, the tool then extends these fiber optic assemblies with protective casings out of the tool motherboard to reach different targets in the formation for maximum production. Similar commercial tools are used in the industry based on jetting fluid (water) or acid; however, these have limitations, such as type of formation, formation stresses, and conditions of the reservoir. The disclosed tool and methods use high power laser technology instead of fluids, which is stress independent and has the ability to penetrate in any formation under any conditions. The disclosed tools and methods can save time, reduce cost and improve production by connecting producing tunnels from the wellbore to the hydrocarbon-bearing formation.

In one aspect, the application relates to a laser perforation tool configured for use in a downhole environment of a wellbore within a hydrocarbon bearing formation. The tool includes a plurality of perforation means disposed within an elongate tool body, where each perforation means is configured for perforating the wellbore and includes one or more optical transmission media. The one or more optical transmission media being part of an optical path originating at a laser generating unit configured to generate at least one raw laser beam and the one or more optical transmission media configured for passing the at least one raw laser beam. The tool also includes a plurality of laser heads, each coupled to one of the one or more optical transmission media and configured for receiving the at least one raw laser beam, and deployment means for extending the plurality of perforation means through one or more exit ports disposed in a side wall of the tool body. Each laser head includes an optical assembly for controlling at least one characteristic of an output laser beam.

In various embodiments, the tool includes a plurality of orientation nozzles disposed about an outer circumference of each of the laser heads, the plurality of nozzles configured to control motion and orientation of each of the perforation means within the wellbore. In some embodiments, the deployment means includes the plurality of orientation nozzles disposed about an outer circumference of each of the laser heads, the plurality of nozzles configured to provide forward, reverse, or rotational motion to each of the perforation means within the wellbore. In some embodiments, the deployment means includes a screw rod.

Additionally, the tool may include a purging assembly disposed at least partially within or adjacent to each of the laser heads and configured for delivering a purging fluid to an area proximate each of the output laser beams. In some embodiments, the tool may include a control system to control at least one of a motion or a location of the laser head or an operation of the optical assembly to direct the output laser beams within the wellbore.

The optical assembly may include one or more lenses for manipulating the raw laser beam. For example, the optical assembly may include a first lens for focusing the raw laser beam and a second lens for shaping the output laser beam. In some embodiments, a distance between the first lens and the second lens is adjustable to control a size of the output laser beam.

In various embodiments, the plurality of perforation means includes an array of eight perforation assemblies deployable radially outward from the tool body. In some embodiments, the plurality of perforation means includes a second array of perforation assemblies disposed a distance along the tool body from the first array and deployable radially outward from the tool body.

In some embodiments, the perforation assemblies are substantially rigid upon deployment and define a substantially linear path, and in others, the perforation assemblies are substantially flexible upon deployment and define a substantially non-linear path. In some embodiments, the perforation assemblies are steerable and can travel an irregular or curved path.

Furthermore, in some embodiments, at least a portion of the purge nozzles are vacuum nozzles connected to a vacuum source and configured to remove debris and gaseous fluids from the area proximate the output laser beam. Additionally, the plurality of orientation nozzles can be purge nozzles configured to provide thrust to each of the laser heads for movement within the wellbore. In some embodiments, the plurality of orientation nozzles are movably coupled to each of the laser heads to allow the orientation nozzles to rotate or pivot relative to each of the laser heads to provide forward motion, reverse motion, rotational motion, or combinations thereof to each of the laser heads relative to the tool.

In additional embodiments, the tool includes at least one centralizer coupled to the tool and configured to hold the tool in place relative to an outer casing in the wellbore. In some cases, the tool includes a plurality of centralizers disposed on the tool body and where a first portion of centralizers is disposed forward of the perforation means and a second portion of centralizers is disposed aft of the perforation means.

In some embodiments, the laser head is a distal portion of a casing disposed within the tool body and deployable with the perforation means and each of the perforation means can be disposed within each of the casings. In some cases, the perforation means are removable from the casings and the casings are configured to pass a hydrocarbon fluid from the formation to the wellbore.

In another aspect, the application relates to a method of using a laser tool to stimulate a hydrocarbon-bearing formation. The method includes the steps of positioning the laser tool within a wellbore within the formation, where the laser tool includes a plurality of perforation means disposed therein, and passing, through one or more optical transmission media, at least one raw laser beam generated by a laser generating unit at an origin of an optical path that includes the one or more optical transmission media and the plurality of perforation means are coupled to the laser generating unit. The method further includes deploying the plurality of perforation means out of a body of the tool, delivering the raw laser beam to an optical assembly disposed within each of the perforation means, manipulating the raw laser beam with each optical assembly to produce an output laser beam from each optical assembly, and delivering the output laser beams to the formation. In some embodiments, the method includes the step of orienting the perforation means within the wellbore using a plurality of nozzles coupled to the perforation means.

Definitions

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

Circumference: As used herein, the term "circumference" refers to an outer boundary or perimeter of an object regardless of its shape, for example, whether it is round, oval, rectangular or combinations thereof.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

Figure 1:
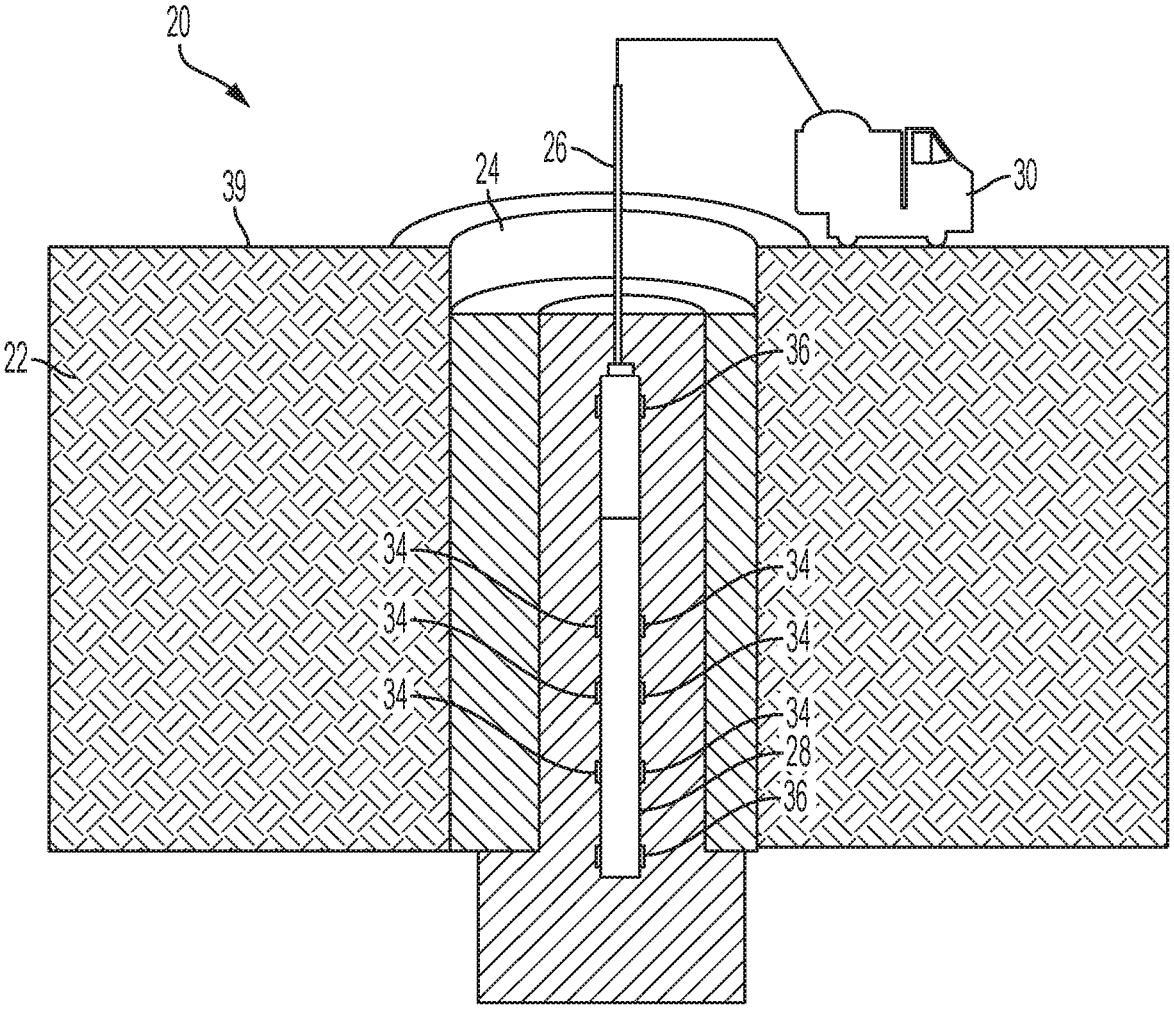
FIG. 1 is a schematic representation of a high power laser tool disposed within a wellbore in accordance with one or more embodiments.

FIG. 1 depicts a portion of a fiber optic laser perforation tool 20 that is configured to be lowered downhole via any service provider using a coiled tube unit, wireline, or tractors as known in the art. The tool 20 includes a tool body 28 that houses a plurality of perforation means 32 (see FIG. 2) and defines a series of exit ports 34 disposed about the circumference of the tool body 28 to allow the perforation means 32 to be deployed into a wellbore 24 of the formation 20. The tool 20 also includes centralizers 36 for holding the tool 20 in position within the wellbore 24 and to isolate a zone if needed to perform a specific task in that zone upon reaching a target. The perforation means 32 are described in greater detail with respect to FIGS. 2-7.

The centralizers 36 can be disposed at various points along the tool body 28 as need to suit a particular application. The centralizers 36 can also help support the weight of the tool 20 and can be spaced along the tool body 28 as needed to accommodate the tool 20 extending deeper into the formation. The centralizers 36 can include an elastomeric material that expands when wet, bladders that can be inflated hydraulically or pneumatically from the surface, or by other mechanical means.

As further shown in FIG. 1, the tool 20 is coupled to a laser generating unit 30 disposed on the surface 39 in a vicinity of the wellbore 24 via a cable 26. The cable 26 can include the optical transmission media (for example, fiber optics), along with any power or fluid lines as needed to operate the tool 20. The cable 26 extends from a laser generating unit 30 to the plurality of perforation means 32 disposed within the tool body 28.

Figure 2:
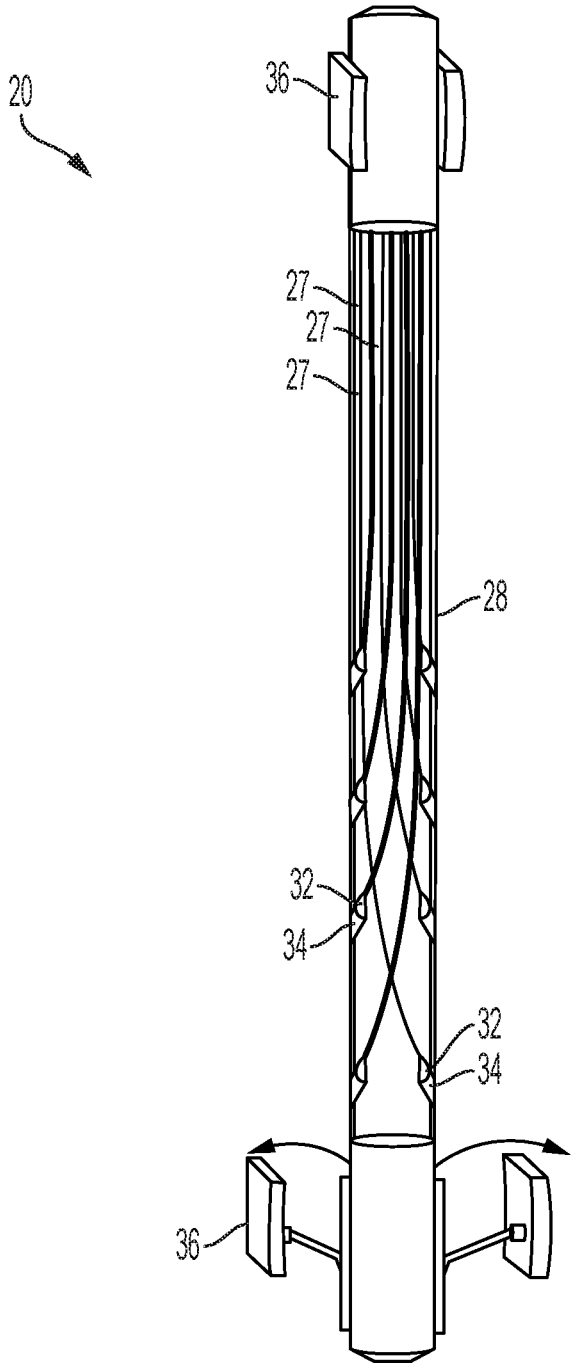
FIG. 2 is a schematic representation of the laser tool depicted in FIG. 1 in accordance with one or more embodiments.
Figure 8:
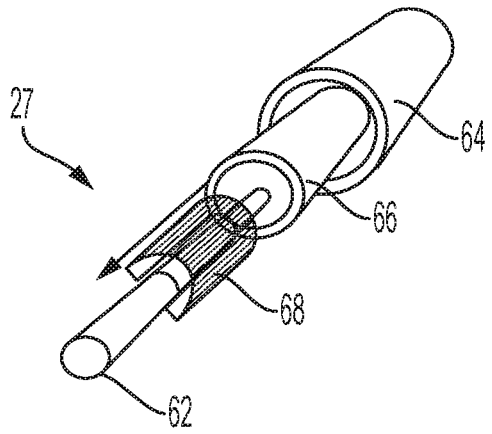
FIG. 8 is a partial, exploded perspective view of fiber optic cable for use in a tool in accordance with one or more embodiments.
Figure 15B:
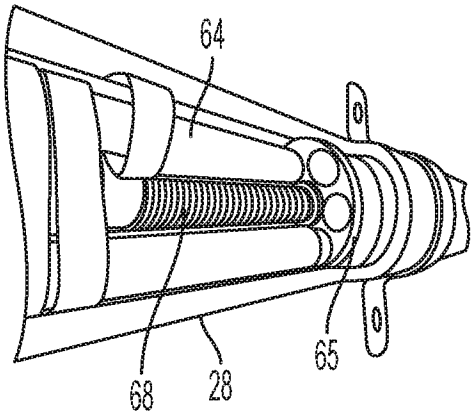
FIGS. 15A and 15B are pictorial representations of a method of bundling and deploying cable arrays.
Figure 15A:
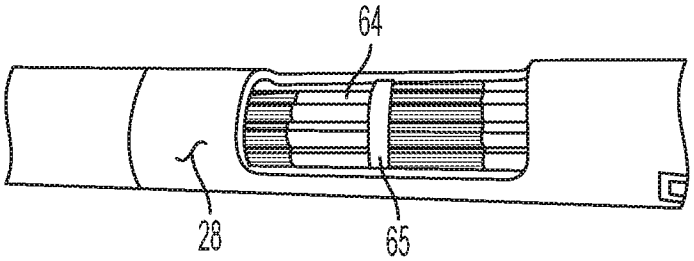

FIG. 2 depicts one embodiment of the laser tool 20 in a partial cross-section to better illustrate the perforation means 32. The tool 20 houses bundles or arrays of perforation means 32, each one of which includes a fiber optic cable 27 for coupling a laser head 38 (see FIG. 3) to the laser generating unit 30. The energy from the laser generating unit 30 is transmitted to the tool 20, specifically each individual perforation means 32, via the fiber optic cables 27, which are shielded as shown in FIG. 8, to protect the fiber optic cables 27 from the downhole environment. The cables 27 may be bundled within the tool 20 in accordance with the same means as used for different materials/applications in the industry. FIGS. 15A and 15B provide pictorial images of a commonly used bundle arrangement for illustrative purposes. As can be seen in FIGS. 15A and 15B, a portion of the tool body 28 is cut-away to show a bundle of casings 64 secured in a deployable manner within the tool body 28. Each casing 64 houses at least one fiber optic cable 27. In some embodiments, the casings 64 may be aligned or secured within the body 28 by one or more jigs 65 or other structure to hold the casing in position and guide its deployment.

FIG. 8 depicts one example of an internal configuration of a fiber optic cable 27 that can be shielded with a hard or flexible case. In both types, the fiber must be protected from high temperature, pressure, and downhole conditions such as fluids, hydrogen gases, stress, vibration, etc. As shown, the cable 27, includes an outer shield of a high temperature/pressure resistant casing 64, then a high temperature/pressure resistant insolation cable 66 to maintain a temperature of the fiber optics cable, as high temperature will damage the cable, then a protective cable 68, which typically comes with the fiber optics manufacturer, and then the optical fiber 62 to deliver the raw laser beam.

Figure 11:
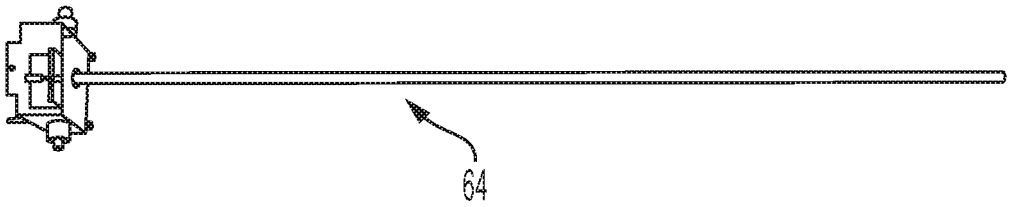
FIG. 11 is a pictorial representation of a rigid perforation means for use in a tool in accordance with one or more embodiments.
Figure 12:
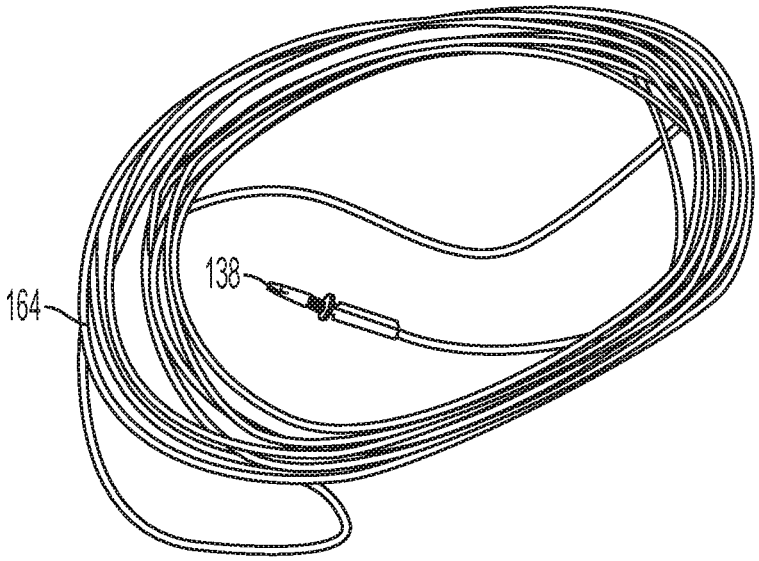
FIG. 12 is a pictorial representation of a flexible perforation means for use in a tool in accordance with one or more embodiments.

Typically, a hard outer casing 64 is made from materials, such as stainless steel or other materials that can be used to penetrate the formation and withstand downhole conditions. An example of an experimental casing made of stainless steel is depicted in FIG. 11. The casing shown in FIG. 11 is rigid and is deployed in a substantially straight line. Alternatively, a flexible casing 164 can be used, such as the one depicted in FIG. 12. For a flexible casing 164, the laser head 138 should include orientation means, such as those to be described later, to direct the cable 26 into the formation.

Referring back to FIG. 2, the tool 20 holds the plurality of fiber optic cables 27 as bundles or arrays running longitudinally within the tool body 28. The tool 20 shown includes eight (8) individual cables 27; however various embodiments will include different multiples of cables 27 as necessary to suit a particular application and may include, for example, two, four, six, ten or more cables or even sets of cables disposed at different positions along the tool body (see FIG. 9). The cables 27 are inserted and aligned in the tool 20, with the tip (laser heads 38) aligned with the exit ports 34, such that one cable 27 is aligned with one exit port 34. When the tool 20 reaches the target, the cables 27 will be deployed from the tool body 28. In some embodiments, the cables 27 are pushed out of the tool 20 via an actuator on the surface acting on at least a portion of the main cable 26. The actuator may be electrically, hydraulically, or pneumatically driven.

In various embodiments, the cables 27 may also be deployed by, or the deployment assisted by, the orientation nozzles 44 to be described later. The exit ports 34 shown in FIG. 2 are disposed on diametrically opposed surfaces of a circumference of the tool body 28; however, the exit ports 34 can be positioned anywhere along the tool body 20 to suit a particular application. For example, in some embodiments, the exit ports may be oriented in a spiral-like pattern where the ports 34 are spaced along a length of the tool body and radially off-set at regular angular intervals, for example, every 30 degrees, or at irregular intervals to suit a particular application. In addition, the tool 20 can be centralized by the centralizer pads 36, which can be inflated at a target position to ensure that the tool 20 is in the center of the wellbore and correctly aligned with the target. The tool 20 can also be equipped with logging and sensing to identify the target, for example, fiber optic cables, acoustic sensors, or sonic logging.

Figure 3:
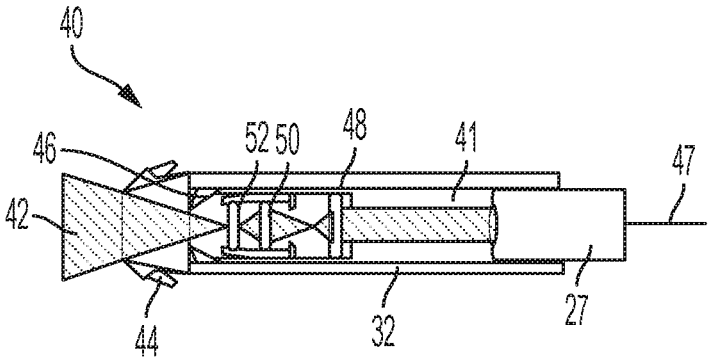
FIG. 3 is a schematic representation of a laser head for use with the laser tool of FIG. 2 in accordance with one or more embodiments.
Figure 4:
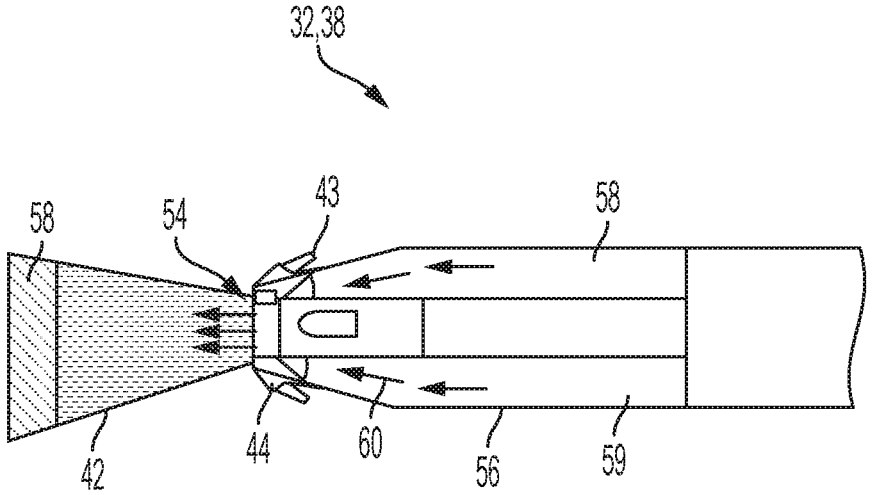
FIG. 4 is another schematic representation of the laser head of FIG. 3 in accordance with one or more embodiments.
Figure 5:
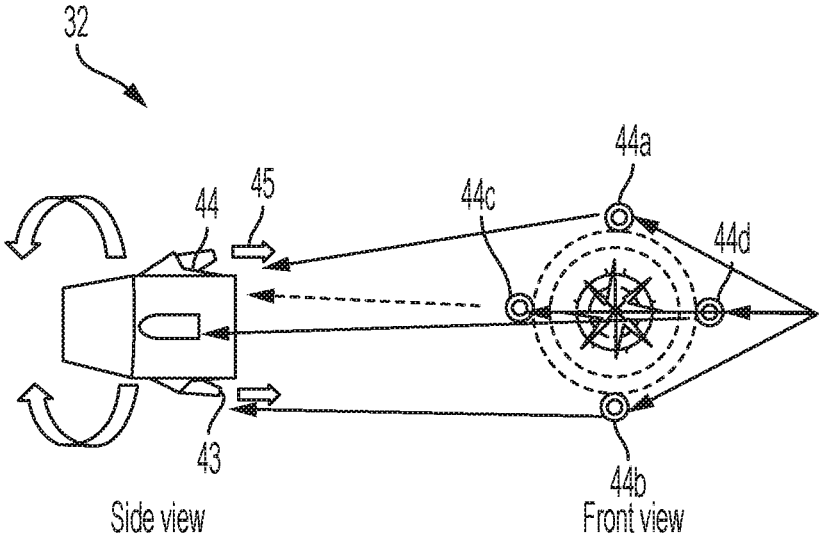
FIG. 5 is a schematic representation of a portion of the laser head of FIG. 3 in accordance with one or more embodiments.

The laser head 38 is depicted in detail in FIGS. 3-5. Referring to FIG. 3, the laser head 38 is shown disposed at a distal end of each cable 27 and houses an optical assembly 40 to make up the basic perforation means 32. In some embodiments, the laser head 38 is a distal portion of the casing 64 in which the fiber optic cable is secured. The laser head 38 can be coupled to the cable 27 by any one of various mechanical means known in the art to provide the raw laser beam 41 to the optical assembly 40, which includes one or more lenses as necessary to condition the raw laser beam 41 to suit a particular application.

The optical assembly shown in FIG. 3 includes a first lens 48, a second lens 50, and a cover lens 52. In operation, the raw laser beam 41 enters the laser head 38 and the optical assembly 40 via the first lens 48, which will focus the beam at a point, the beam will then defocus into the second lens 50, which can shape or collimate the beam as necessary to suit a particular application and the size and shape of the beam required. In various embodiments, a distance between the lenses 48, 50 can be adjusted to control the size of the beam. The beam exits the laser head through the cover lens 52 as a shaped, output beam 42.

In addition, and as shown in greater detail in FIGS. 4 and 5, each laser head 38 can also include a plurality of orientation nozzles 44 and a plurality of purging nozzles 46. The purging nozzles 46 are disposed inside the head 38 for the function of cooling the optical assembly and preventing any back-flow of debris into the head 38. Water or a halocarbon fluid, or generally any fluid or gas that is none damaging and transparent to the laser beam wavelength, can be used to remove the debris. The purge fluid 58 can flow through channels 59 disposed within the laser head 38. In accordance with various embodiments, a portion of the nozzles 46 may be vacuum nozzles connected to a vacuum source and adapted to remove debris and gaseous fluids from around or within the laser head 38.

The orientation nozzles 44 are located on an outer surface of the laser head 38. In the embodiment shown, there are four (4) nozzles 44 shown disposed on and evenly spaced about an outer circumference of the laser head 38. However, different quantities and arrangements of the orientation nozzles 44 are possible to suit a particular application. For example, if the orientation nozzles 44 are used to assist with deploying the perforation means 32 from the tool body 28, there may be additional nozzles 44 disposed on the laser head 38.

Generally, the head 38 is oriented by controlling a flow of a fluid (either liquid or gas) through the nozzles 44. For example, by directing the flow of the fluid in a rearward direction 45 as shown in FIG. 5, the head 38 will be pushed forward in the wellbore by utilizing thrust action, where the openings 43 of the nozzles 44 are facing the opposite directions of the head 38 and the fluid flows backward providing the thrust force moving the perforation means 32 forward. Controlling the flow rate will control the speed of the perforation means 32 within the wellbore. The fluid for providing the thrust can be supplied from the surface and delivered by a fluid line included within the cable 26.

As shown in FIG. 5, there are four (4) nozzles 44*a*, 44*b*, 44*c*, 44*d* evenly spaced around the laser head 38. Each nozzle 44 flows a fluid to allow to the head 38 to move and can be separately controlled. For example, if nozzle 44*a* is the only nozzle on, then the head 38 will turn in the south direction, the turn degree depends on the controlled flow rate from that nozzle 44*a*. If all of the nozzles 44 are evenly turned on, then the tool will move linearly forward or in reverse depending on the position of the nozzles 44.

In various embodiments, the nozzles 44 can be fixedly connected to the laser head 38 for limited motion control or be movably mounted to the laser head 38 for essentially unlimited motion control of the perforation means 32. In one embodiment, the nozzles 44 are movably mounted to the laser head 38 via servo motors with swivel joints that can control whether the nozzle openings 43 face rearward (forward motion), forward (reverse motion), or at an angle to a central axis 47 (rotational motion or a combination of linear and rotational motion depending on the angular displacement of the nozzle 44 relative to the central axis 47). For example, if the nozzles 44 are aligned perpendicular to the central axis, the nozzles 44 will only provide rotational motion. If the nozzles 44 are parallel to the central axis 47, then the nozzles 44 will only provide linear motion. A combination of rotational and linear motion is provided for any other angular position relative to the central axis 47. The fluid lines for providing the thrust can be coupled to the nozzles via swivel couplings as known in the art.

FIG. 4 depicts a laser head 38 with additional features, such as fiber optic sensors 54 for temperature, pressure, or both; and acoustic sensing/logging fibers 56 to monitor the tool 20 performance and collect formation information as logging.

Generally, various advantages of using the high power laser tools disclosed herein include the elimination of using chemicals, such as acids, or other chemicals to penetrate the formation, and the elimination of using high pressures and forces, such as jetting, to drill the hole. However, the laser still requires one or more fluids, but these fluids are used to purge and clean the hole from the debris, opening up a path for the laser beam, and to orient the laser head 38. FIG. 4 depicts an internal configuration of the laser head 38 that is configured to have the purge fluid 58 merge with the laser beam 42. As shown in FIG. 4, the fluid 58 is merged with the beam 42, with the flow direction 60 running longitudinally through the channels 59 formed within the laser head 38.

Figure 6:
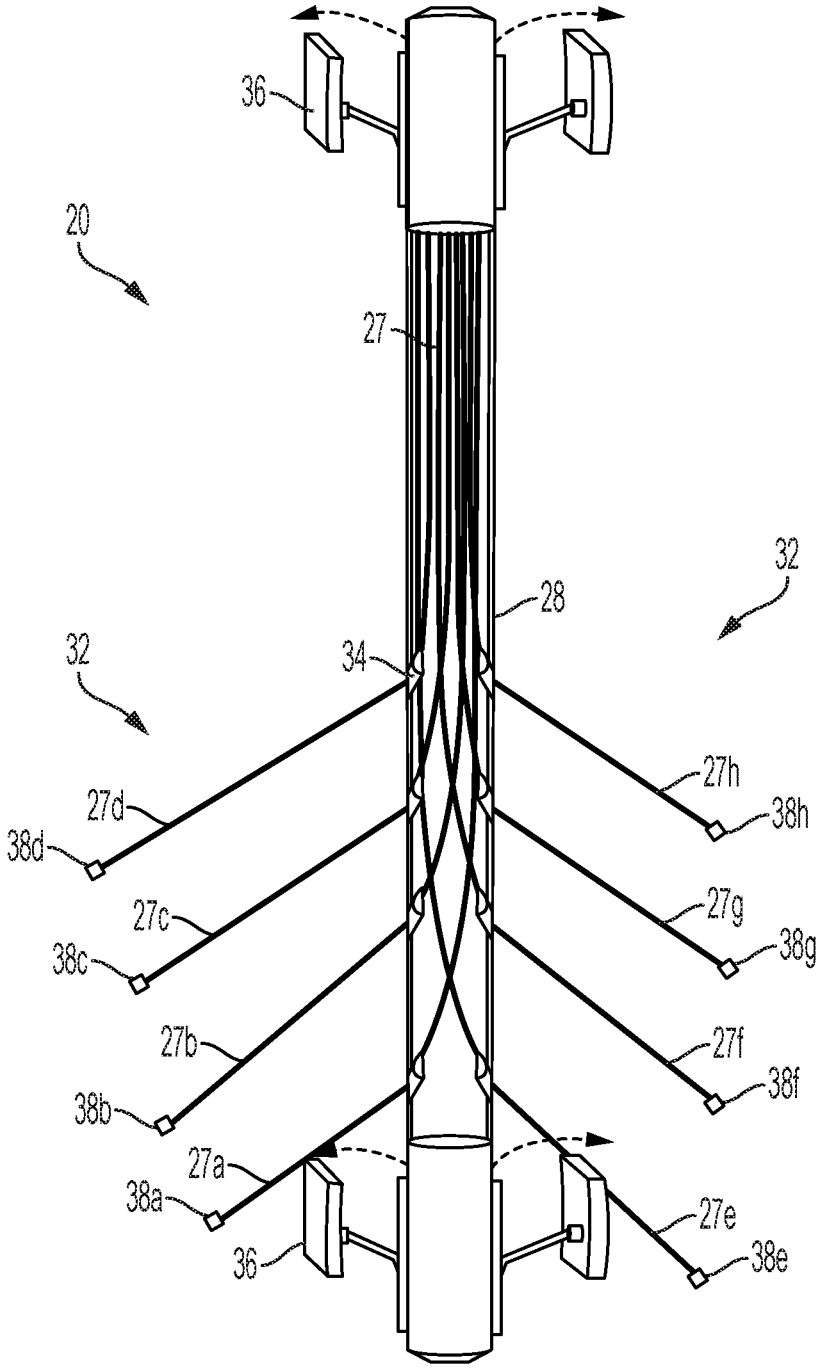
FIG. 6 is a schematic representation of the laser tool of FIG. 2 shown deployed within a hydrocarbon bearing formation in accordance with one or more embodiments of the invention.

FIG. 6 depicts the laser tool 20 in a deployed configuration, where the perforation means 32 have been extended outside of the tool body 28 through the exit ports 34. As previously discussed, the embodiment shown includes eight (8) perforation means 32 including the fiber optic cables 27*a*-27*h* and laser heads 38*a*-38*h*. The perforation means 32 depicted are substantially rigid In various embodiments, the tool 20 is introduced into the wellbore 24 via a coiled tubing unit that is configured to provide a reel, power and fluid for the tool, and host all of the laser supporting equipment. The laser source is also coupled to the coiled tubing unit. The laser generating unit 30 is switched off while the tool 20 is being inserted into the wellbore. Once tool 20 reaches the target, typically an open hole, the centralizers 36 inflate to centralize the tool at that location and the laser will turn on along with the source of purging fluid for the purge nozzles 44 and orientation nozzles 44, if included. The perforation means 32 will be deployed into the formation from the coiled tubing or by the tool 20 itself through a screw rod 68, as shown in FIG. 15B.

Figure 9:
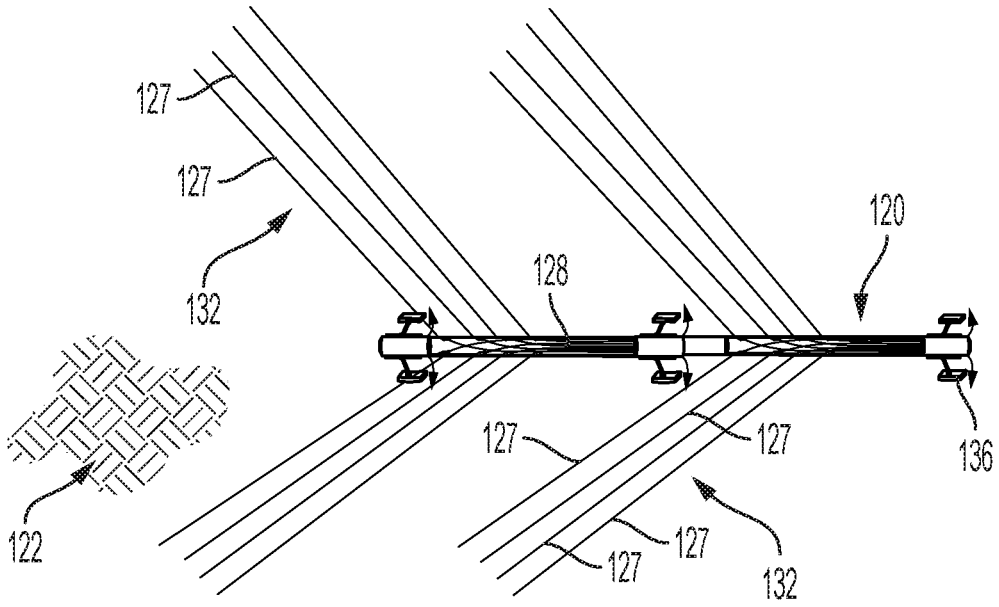
FIG. 9 is a schematic representation of an alternative laser tool in accordance with one or more embodiments.

In various embodiments, each fiber optic cable 27, with shielding, measures about one (1) inch in diameter. Accordingly, an eight (8) inch wellbore can hold seven (7) fiber optic cables, and so on. FIG. 9 depicts an operation where the laser is on and the perforation means 132 are penetrating deeper into the formation 122. Because the cables 127 of the perforation means 132 are substantially rigid (see, for example, FIG. 11), the perforation means 132 penetrate in substantially straight lines. The perforation means 132 can reach as deep as needed, because the cables 127 can be as long as the drilling string from the surface into the wellbore and tool 120. Generally, the embodiment depicted in FIG. 9 has the same basic structure as the tool 20 previously described; however, the number and locations of the perforation means 132 are different. Specifically, there are multiple arrays disposed along the length of the tool 120 separated into different zones by the centralizers 136.

Figure 10:
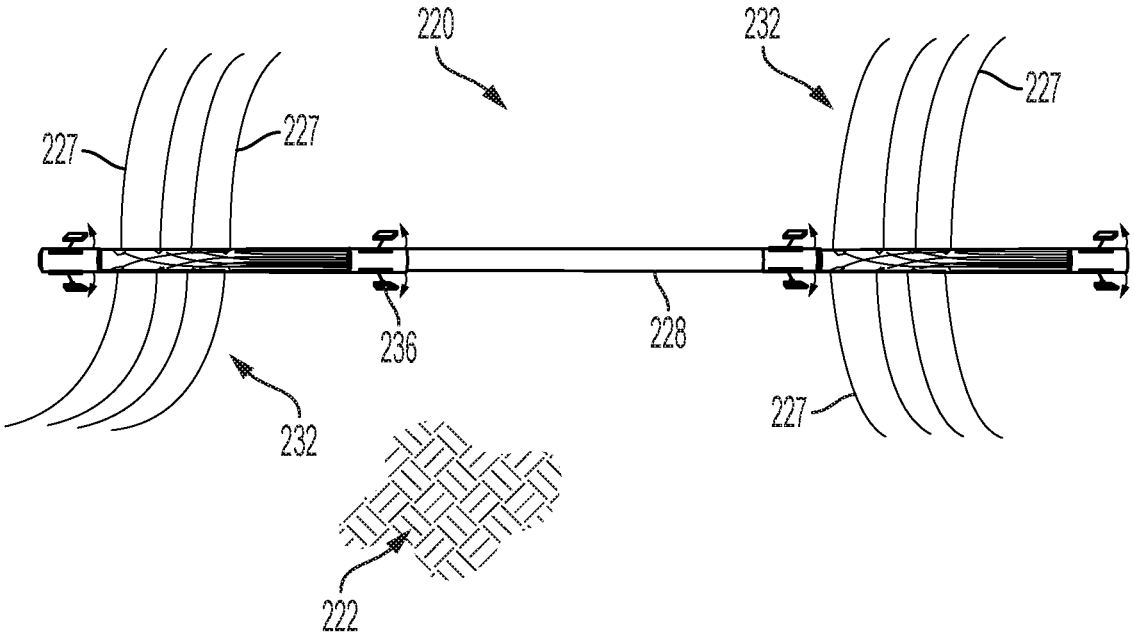
FIG. 10 is a schematic representation of another alternative high power laser tool in accordance with one or more embodiments.

In some embodiments, the target must be reached by maneuvering the perforation means to the target. FIG. 10 depicts an embodiment of the tool 220 in which the perforation means 232 use cables with flexible casings 264 (see, for example, FIG. 12) with orientation capabilities, such as the orientation nozzles 44 previously described. Similar to the tool shown in FIG. 9, the tool 220 includes multiple arrays disposed along the length of the tool 220 separated into different zones by the centralizers 236. As can be seen in FIG. 10, the perforation means 232 can be deployed substantially perpendicular to the tool body 228 and steered along an irregular path as necessary to reach a desired target. The path can include any number and combination of linear and curved segments as necessary. In some embodiments, the ability to maneuver the perforation means 232 within the formation enables deeper and more targeted penetration.

In various embodiments, the tools 20, 120, 220 disclosed herein include additional nozzles or casings 70 that house the cables 27, 127, 227 to assist in deploying and advancing the cables 27, 127, 227 within the formation. The casing 70 can be pre-perforated or a mesh type to allow a flow of oil or gas from the formation 22, 122, 222 into the wellbore. In some embodiments, once the perforation means and casings 70 reach their intended target, the fiber optic cables 27 can be retrieved and another set of fiber optic cables can be used for different locations in the wellbore. Alternatively or additionally, the cables 27 can be removed to allow for the flow of gas or oil through the casings 70 to the well bore.

Figure 7:
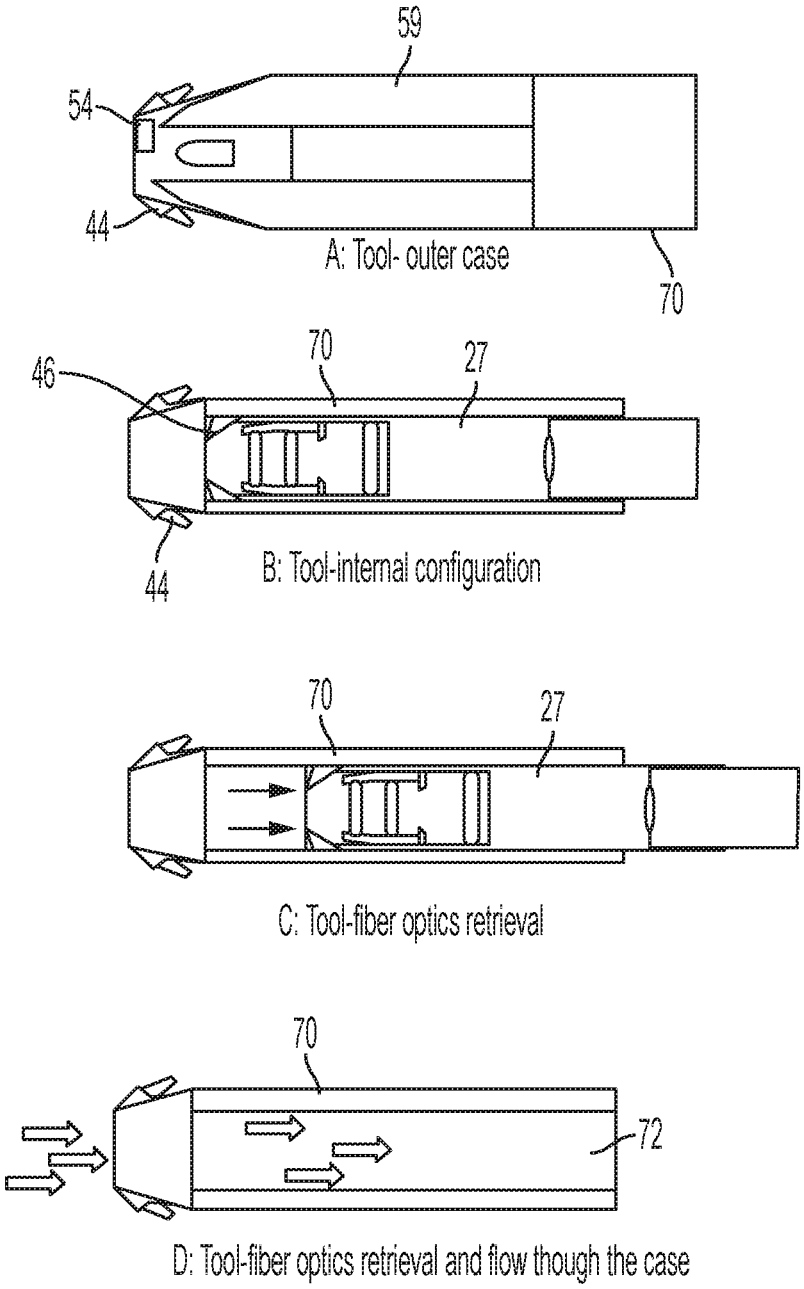
FIG. 7 is a schematic representation of four operational steps of a laser head in accordance with one or more embodiments.

FIG. 7 depicts the cable 27 retrieval process. Step A illustrates the laser head portion of the outer casing 70 with such features as the orientation nozzles and fluid purging channels, but without the fiber optic cable inserted. Step B illustrates the present internal configuration of the casing head with the fiber optic cable 27 attached to the casing head. Step C illustrates the fiber optic cable 27 unscrewed or unplugged from the head and being removed from the casing 70, which can be done via the coiled tubing unit. Generally, the fiber optic cable 27 can be secured within the laser head 38 portion of the casing via any known mechanical fastening means, such as, for example, threaded hardware, quick disconnect couplings, magnets, or an inflatable/deflatable device. For example, for an inflatable/deflatable device, the connection can be inflated while it is connected and deflated for retrieval. The inflation/deflation can be controlled electrically, hydraulically, or mechanically. Step D illustrates the complete removal of the fiber optic cable 27 and a hydrocarbon fluid 72 flowing into the casing 70. In this embodiment, the casing 70 is acting as a completion pipe that the fluid flows through into the wellbore. In some embodiments, an alternative fiber optic cable or other tool could be inserted into the casing 70 to perform additional tasks.

Figure 13:
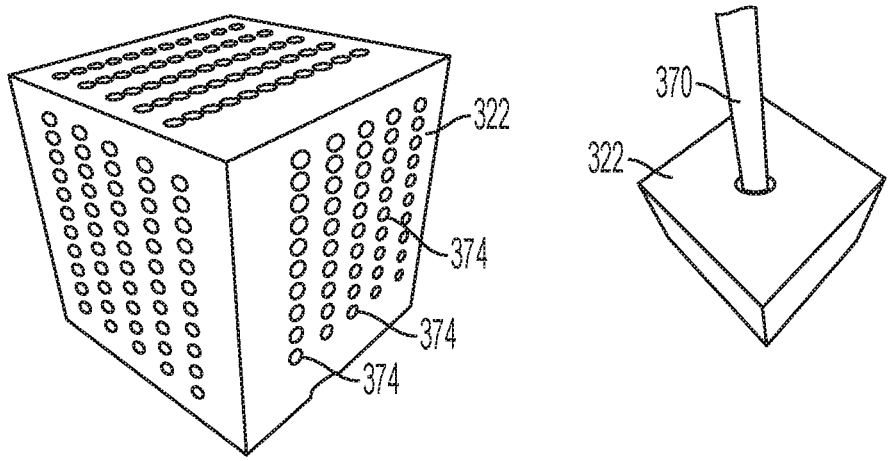
FIG. 13 is a pictorial representation of a sample rock formation after operation of one embodiment of a laser tool in accordance with one or more embodiments of the methods disclosed herein.

One advantage of using high power laser technology is the ability to create controlled non-damaged, clean holes regardless of the stress and type of the rock. FIG. 13 represents a proof of concept example for a tool as described herein. As shown on the right, a single fiber optic cable 327 and casing 370 are introduced to a sample rock formation 322. On the left, is the rock formation 322 after a series of holes 374 have been drilled into the formation 322 with a tool in accordance with one or more embodiments described herein.

Figure 14:
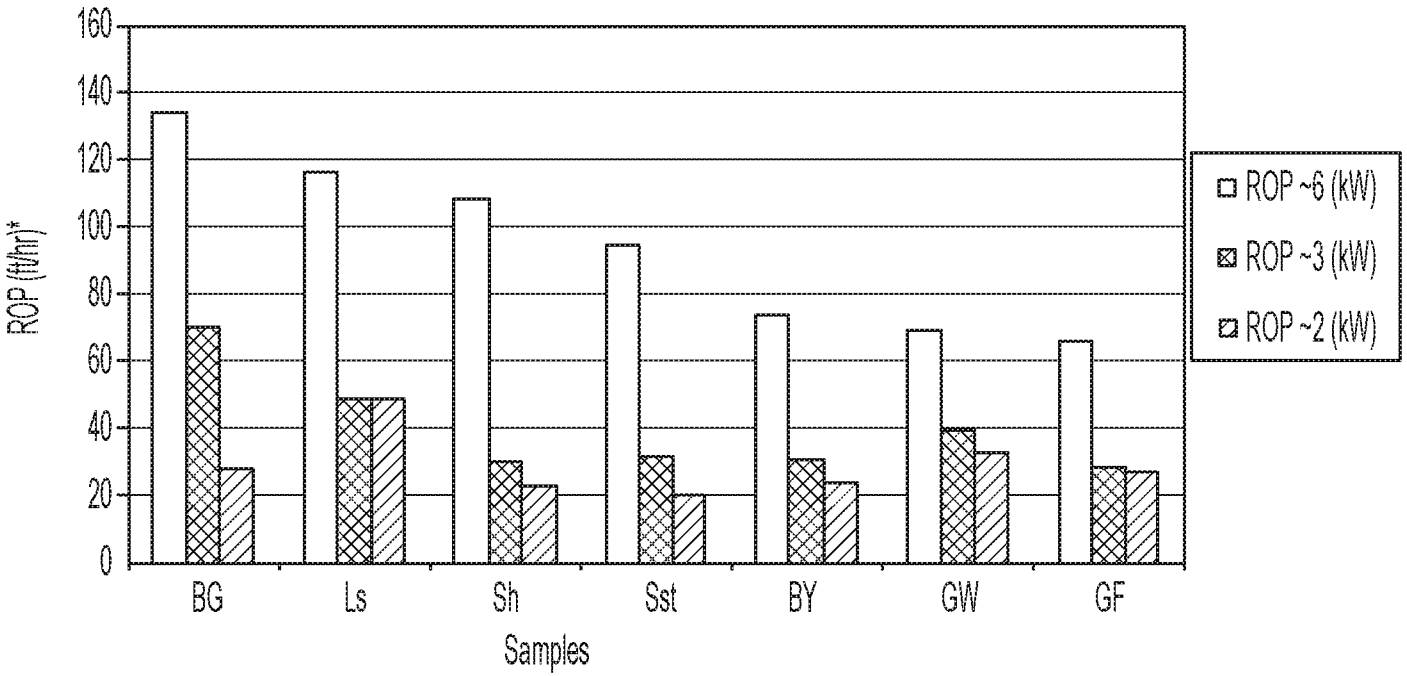
FIG. 14 is a graphical representation of the results of the use of a tool in accordance with one or more embodiments of the methods disclosed herein.

The laser tools disclosed herein have been proven to penetrate in all types of rocks regardless of the rocks' strength and stress orientation, as shown in the graph of FIG. 14. The graph represents the Rate of Penetration (ROP) in feet per hour (ft/hr) for a variety of materials, where BG and BY=Brea Gray, Ls=limestone, Sh=shale, Sst=sandstone, and GW and GF=granite. The laser strengths used were at 2 kW, 3 kW, and 6 kW power.

In general, the construction materials of the downhole laser tool can be of any types of materials that are resistant to the high temperatures, pressures, and vibrations that may be experienced within an existing wellbore, and that can protect the system from fluids, dust, and debris. Materials that are resistant to hydrogen sulfide are also desirable. One of ordinary skill in the art will be familiar with suitable materials.

The laser generating unit can excite energy to a level greater than a sublimation point of the hydrocarbon bearing formation, which is output as the raw laser beam. The excitation energy of the laser beam required to sublimate the hydrocarbon bearing formation can be determined by one of skill in the art. In some embodiments, the laser generating unit can be tuned to excite energy to different levels as required for different hydrocarbon bearing formations. The hydrocarbon bearing formation can include limestone, shale, sandstone, or other rock types common in hydrocarbon bearing formations. The discharged laser beam can penetrate a wellbore casing, cement, and hydrocarbon bearing formation to form, for example, holes or tunnels.

The laser generating unit can be any type of laser unit capable of generating high power laser beams, which can be conducted through a fiber optic cable, such as, for example, lasers of ytterbium, erbium, neodymium, dysprosium, praseodymium, and thulium ions. In some embodiments, the laser generating unit includes, for example, a 5.34-kW Ytterbium-doped multi-clad fiber laser. In some embodiments, the laser generating unit can be any type of laser capable of delivering a laser at a minimum loss. The wavelength of the laser generating unit can be determined by one of skill in the art as necessary to penetrate hydrocarbon bearing formations.

At least part of the laser tool and its various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain actions is immaterial, so long as the described method remains operable. Moreover, two or more steps or actions may be conducted simultaneously.

What is claimed is:

1. A laser perforation tool configured for use in a downhole environment of a wellbore within a hydrocarbon bearing formation, the tool comprising:

a plurality of perforation means disposed within an elongate tool body, each perforation means configured for perforating the wellbore and comprising:

one or more optical transmission media, the one or more optical transmission media being part of an optical path originating at a laser generating unit configured to generate at least one raw laser beam, the one or more optical transmission media configured for passing the at least one raw laser beam;

a laser head coupled to the one or more optical transmission media and configured for receiving the at least one raw laser beam, the laser head comprising an optical assembly for controlling at least one characteristic of an output laser beam; and a plurality of orientation nozzles disposed about an outer circumference of the laser head, the plurality of nozzles configured to control motion and orientation of each of the perforation means within the wellbore; and deployment means for extending the plurality of perforation means through one or more exit ports disposed in a side wall of the tool body.

2. The tool of claim 1, where the deployment means comprises a plurality of orientation nozzles disposed about an outer circumference of each of the laser heads, the plurality of nozzles configured to provide forward, reverse, or rotational motion to each of the perforation means within the wellbore.

3. The tool of claim 1, where the deployment means comprises a screw rod.

4. The tool of claim 1, further comprising a purging assembly disposed at least partially within or adjacent to each of the laser heads and configured for delivering a purging fluid to an area proximate to each of the output laser beams.

5. The tool of claim 1, further comprising a control system to control at least one of a motion or a location of the laser head or an operation of the optical assembly to direct the output laser beams within the wellbore.

6. The tool of claim 1, where the optical assembly comprises one or more lenses for manipulating the raw laser beam.

7. The tool of claim 6, where the optical assembly comprises a first lens for focusing the raw laser beam and a second lens for shaping the output laser beam.

8. The tool of claim 7, where a distance between the first lens and the second lens is adjustable to control a size of the output laser beam.

9. The tool of claim 1, where the plurality of perforation means comprises an array of eight perforation assemblies deployable radially outward from the tool body.

10. The tool of claim 9, where the plurality of perforation means comprises a second array of perforation assemblies disposed a distance along the tool body from the first array and deployable radially outward from the tool body.

11. The tool of claim 9, where the perforation assemblies are substantially rigid upon deployment and define a substantially linear path.

12. The tool of claim 9, where the perforation assemblies are substantially flexible upon deployment and define a substantially non-linear path.

13. The tool of claim 12, where the perforation assemblies are steerable to define an irregular or curved path.

14. The tool of claim 1, further comprising a plurality of vacuum nozzles connected to a vacuum source and configured to remove debris and gaseous fluids from the area proximate the output laser beam.

15. The tool of claim 1, where the plurality of orientation nozzles are purge nozzles configured to provide thrust to each of the laser heads for movement within the wellbore.

16. The tool of claim 15, where the plurality of orientation nozzles are movably coupled to each of the laser heads to allow the orientation nozzles to rotate or pivot relative to each of the laser heads to provide forward motion, reverse motion, rotational motion, or combinations thereof to each of the laser heads relative to the tool.

17. The tool of claim 1, further comprising at least one centralizer coupled to the tool and configured to hold the tool in place relative to an outer casing in the wellbore.

18. The tool of claim 17, where the tool comprises a plurality of centralizers disposed on the tool body and where a first portion of centralizers is disposed forward of the perforation means and a second portion of centralizers is disposed aft of the perforation means.

19. The tool of claim 1, where the laser head is a distal portion of a casing disposed within the tool body and deployable with the perforation means.

20. The tool of claim 19, where the perforation means are disposed within each of the casings.

21. The tool of claim 20, where the perforation means are removable from the casings and the casings are configured to pass a hydrocarbon fluid from the formation to the wellbore.

22. A method of using a laser tool to stimulate a hydrocarbon-bearing formation, the method comprising the steps of:

positioning the laser tool within a wellbore within the formation, the laser tool comprising a plurality of perforation means disposed therein;

orienting the perforation means within the wellbore using a plurality of nozzles coupled to the perforation means;

passing, through one or more optical transmission media, at least one raw laser beam generated by a laser generating unit at an origin of an optical path comprising the one or more optical transmission media, where the plurality of perforation means are coupled to the laser generating unit;

deploying the plurality of perforation means out of a body of the tool;

delivering the raw laser beam to an optical assembly disposed within each of the perforation means;

manipulating the raw laser beam with each optical assembly to produce an output laser beam from each optical assembly; and delivering the output laser beams to the formation.

* * * * *